US006640048B2

(12) United States Patent
Novotny et al.

(10) Patent No.: US 6,640,048 B2
(45) Date of Patent: Oct. 28, 2003

(54) INSTANT WATER HEATER

(76) Inventors: Don Novotny, 975 Muirlands Dr., La Jolla, CA (US) 92037; Ivanhoe Chaput, 3545-A Lomita Blvd., Torrance, CA (US) 90505

( * ) Notice: Subject to any disclaimer, the term of this patent is extended or adjusted under 35 U.S.C. 154(b) by 8 days.

(21) Appl. No.: 10/107,954

(22) Filed: Mar. 26, 2002

(65) Prior Publication Data

US 2003/0185548 A1 Oct. 2, 2003

(51) Int. Cl.[7] ..... H05B 3/60

(52) U.S. Cl. ..... 392/314; 392/315; 392/317; 392/323; 392/329; 392/330; 392/334; 392/338

(58) Field of Search ..... 392/314, 315, 392/316, 317, 318, 323, 329, 330, 334, 338, 503; 264/29.1, 29.5; 219/437, 523, 535; 204/280, 291

(56) References Cited

U.S. PATENT DOCUMENTS

| | | | | | |
|---|---|---|---|---|---|
| 731,339 | A | | 6/1903 | Chapman | |
| 1,322,860 | A | | 11/1919 | Wubbens et al. | |
| 1,436,089 | A | | 11/1922 | Gorlov | |
| 1,553,491 | A | | 9/1925 | Werner | |
| 1,570,670 | A | | 1/1926 | Horswill | |
| 1,615,819 | A | | 2/1927 | Armstrong | |
| 1,648,588 | A | | 11/1927 | Nerew | |
| 1,696,828 | A | | 12/1928 | Price-Williams | |
| 2,312,677 | A | | 3/1943 | Shrum | |
| 2,725,458 | A | | 11/1955 | Bremer | |
| 2,776,359 | A | | 1/1957 | Bremer | |
| 2,792,487 | A | | 5/1957 | Minier | |
| 3,796,857 | A | | 3/1974 | Henley et al. | |
| 3,925,638 | A | * | 12/1975 | Scatoloni | 392/338 |
| 3,978,313 | A | * | 8/1976 | Curchod et al. | 392/315 |
| 4,266,116 | A | * | 5/1981 | Bauer et al. | 392/338 |
| 4,286,111 | A | * | 8/1981 | Massey et al. | 392/338 |
| 4,439,669 | A | * | 3/1984 | Ryffel | 392/338 |
| 4,730,098 | A | * | 3/1988 | Cave | 392/314 |
| 5,058,192 | A | | 10/1991 | Miyahara | |
| 5,582,781 | A | * | 12/1996 | Hayward | 264/29.5 |
| 5,882,570 | A | * | 3/1999 | Hayward | 264/29.1 |
| 6,080,973 | A | | 6/2000 | Thweatt, Jr. | |
| 6,217,800 | B1 | * | 4/2001 | Hayward | 264/29.1 |

* cited by examiner

*Primary Examiner*—Teresa Walberg
*Assistant Examiner*—Fadi H. Dahbour
(74) *Attorney, Agent, or Firm*—Donald D. Mon

(57) ABSTRACT

An in-line water heater utilizing electrically conductive polymer structures for electrodes. The area of electrodes that confront one another can be varied, and thereby the temperature to which the water is heated can be variably adjusted. The heat is not generated by the electrodes, but instead by the resistance of the water to the electrical current flowing between them. While the electrodes can be moved relative to one another, preferably they will be fixed, and an non-electrically conductive current gating plate can adjustably be placed between them to variably adjust the amount of confronting areas. A field obstructor can be provided at the inlet and outlet of the heater housing to prevent the exit of electrical current from the heater electrodes, and also non-conductive grounding screens in place for secondary safety.

24 Claims, 15 Drawing Sheets

INSTANT WATER HEATER

FIELD OF THE INVENTION

An instant water heater which heats water flowing between two immersed electrodes.

BACKGROUND OF THE INVENTION

This invention relates to water heaters of the type which heat water that flows between two electrodes, rather than by providing a hot element which is contacted by the water. In this invention, the water is heated by electrical current flowing through the water when the water is between the two electrodes.

So called "instant" water heaters differ from conventional water heaters by their lack of a storage tank for hot water. Instead of heating and storing water for future usage, instant water heaters accept cold or cool water, heat it, and deliver it directly to the user point on demand. Such heaters find their most common usages in sink faucets, showers and tubs, although they can be provided for any other usage that requires hot water.

Among their advantages is that they can be placed very near to the use point. Pipes of substantial length need not be emptied of cold water before hot water arrives from a central source, for example. Also, it is much easier to run an electrical circuit to a distant heater than to provide a distant tank, or a long pipe to convey hot water from a central source to a distant use point.

Legionnaire's Disease is well-known as a consequence of water stored for long periods at moderate temperature. Having no storage of the water at all profoundly reduces risk of such disease.

Presently-known instant water heaters do have major disadvantages, including short product life, short service life, liability to water damage, moderate rates of flow, high energy consumption, and release of metal ions into the water.

Yet another disadvantage of existing instant water heaters is their inability to accommodate varying input voltages and amperage along with water flow that matches their intended use. A complaint often heard is that a wrong instant water heater was purchased from among many different models. The necessary wide range for variables, such as voltage and circuit breaker amperage, and service flow in gallons is simply too confusing for many customers.

It is yet another disadvantage of existing instant water heaters that they often burn out or break coils due to water hammering, air in the water lines, or current overloads. These pose an electrical danger from direct contact of live broken coil ends to the water. Then electrical current passes directly into the water. Manifolds are connected to ground with a grounding wire corrode, and it is only a matter of time before a corroded manifold or a burned out coil releases a full current load into the water and out a faucet or other plumbing fixture when in use, to the risk of the user.

It is an object of this invention to provide an instant water heater whose energy consumption is less than that of known conventional types, and whose lifetime is longer, with less frequent service requirements.

It is another object of this invention to provide a water heater whose output temperature can readily be adjusted, and which is electrically very safe.

It is another object of this invention to provide electrodes for an instant water heater which are resistant to wear and corrosion, and which tend more to resemble thermal insulators than to metal conductors as to thermal characteristics.

It is another object of this invention to provide an instant water heater that has grounding screens which are resistant to corrosion, rather than conventional metallic grounding screens or grounding manifolds.

It is another object of the invention to provide a water heater that will accommodate a surprisingly large range of available input voltages and water flows, with only two simple installation adjustments.

It is another object of the invention to prevent shock hazard by introducing a corrosion resistant field obstructor at both the inlet and the outlet of the water heater. These field obstructors eliminate dangerous electrical leakage current that egress the water heater electrodes.

It is yet another object of the invention to provide non-corrosive grounding screens made of a conductive polymer placed at the inlet and outlet of the water heater further eliminating the possibility of inevitable electrical shock due to corrosion or breakage in the system.

It is yet another object of the invention to eliminate corrosion and extend the life of a water heater by eliminating all contact of liquid to metal throughout the entire system, thus eliminating electrolytic, galvanic and all other forms of corrosion. The additionally provides the advantage that metallic ions are not infused into the hot water supply.

BRIEF DESCRIPTION OF THE INVENTION

An instant water heater according to this invention comprises a heating chamber having an inlet and an outlet. Water to be heated enters the chamber through the inlet, and after being heated, exits through the outlet to a point of use.

A pair of spaced-apart electrodes is mounted in the chamber, so disposed and arranged that a suitable proportion of the water passes between them so as to be heated by current that flows through the water from one electrode to the other.

The temperature to which the water is heated is independent of the rate of flow. It can be regulated by adjusting an electrical current amplitude flow control device (herein frequently called a "current gate") that is disposed between the electrodes. This current gate adjusts the amount of confronting areas of the electrodes. Adjusting the spacing between the electrodes, or shifting them relative to each other can also or instead regulate the attained temperature of water.

According to this invention, the electrodes are principally formed of, and their exposed surfaces are specifically made of, an electrically conductive polymeric resin. According to a preferred but optional feature of the invention, the polymer is loaded with graphite or with graphite combined with carbon fibers to reduce the bulk electrical resistance of the material and provide suitable conductivity for the electrode.

The above and other features of this invention will be fully understood from the following detailed description and the accompanying drawings, in which:

DETAILED DESCRIPTION OF THE INVENTION

Although this invention contemplates a number of physical arrangements for effective heating and for regulation and selection of temperatures to be produced, the principal advantages of this invention are derived from a unique electrode which they all use.

Figure 1:
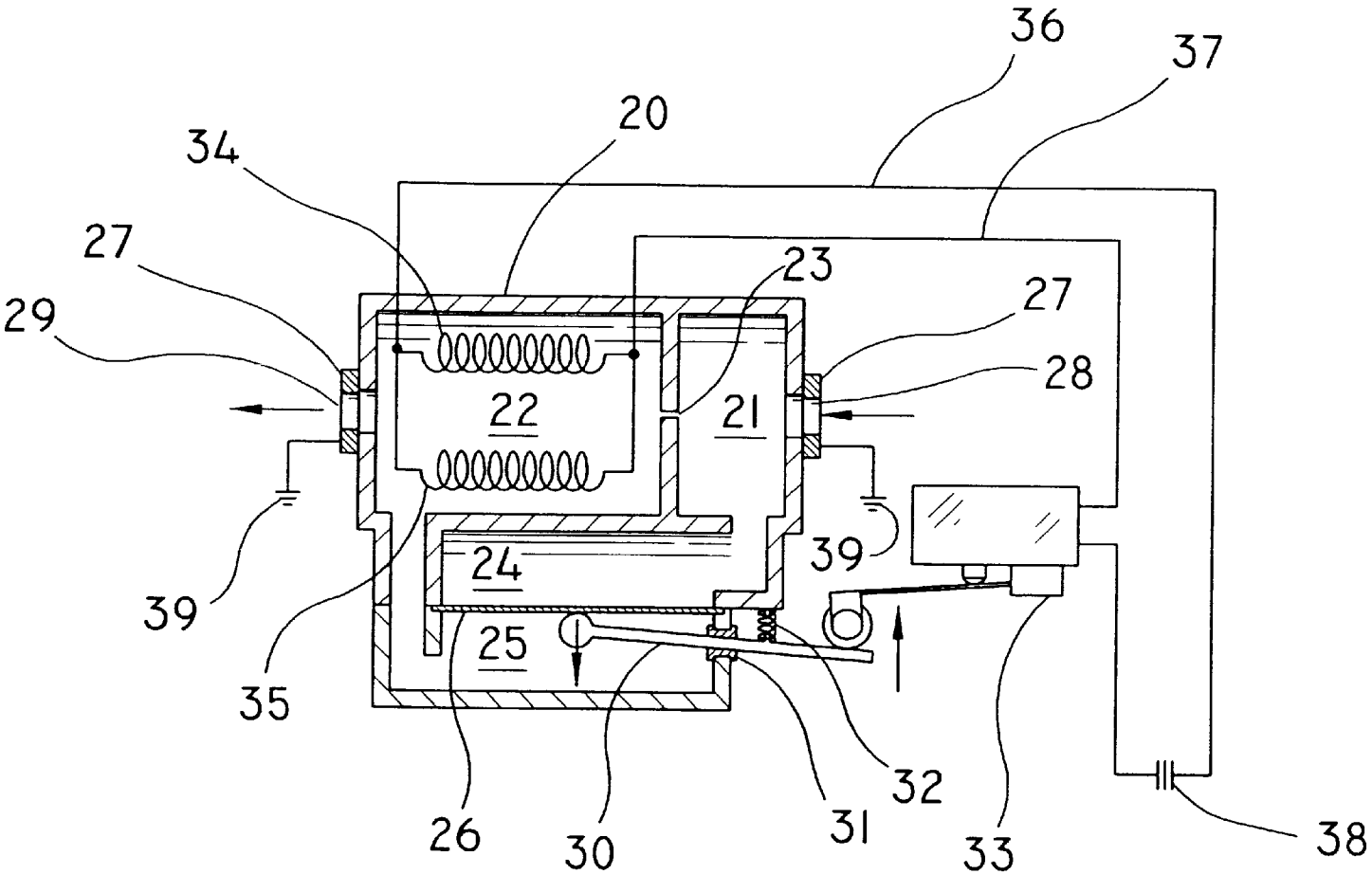
Fig. 1 Prior Art
FIG. 1 is a schematic drawing showing an existing prior art water heater.

The basic scheme of a prior art instant water heater is shown in FIG. 1. Its housing 20 has chambers 21, 22 connected by an orifice 23 having a water inlet 28 and a water outlet 29. Chambers 24, 25 are separated by a resilient diaphragm 26. Chambers 24 and 21, and chambers 25 and 22 are respectively connected by water paths having sufficiently larger cross sections than orifice 23. Metal inlet and outlet manifolds 27, are attached to the inlet 28 and outlet 29, and are electrically connected to ground 39.

A lever 30 passes through a waterproof grommet 31. It is biased against diaphragm 26 by spring 32. A switch 33 is mounted to receive motion in the direction shown for lever 30.

Resistance wire heater coils 34, 35 are mounted in chamber 22. Leads 36, 37 are connected to respective coils 34, 35 through switch 33 and to a source 38 of electrical current. Water to be heated enters inlet 28 in the direction shown by the arrow, and heated water exits outlet 29, from which it is connected to a point of use such as a faucet. An installed instant water heater is pressurized with the line pressure at inlet 28. Pressure on either side of diaphragm 26 is equal when the heater is not being used.

When a point of use such as a faucet is opened, water flows through chamber 21, orifice 23 and chamber 22. Moving fluid is restricted at orifice 23. This imposes a drop in pressure in chambers 22, 25 thereby moving diaphragm 26 in the direction shown by the arrow. Lever 30 acts upon switch 33 to close the circuit and supply current to heater coils 34, 35. Water flowing through chamber 22 while electrical current is flowing through the heater coils will be heated as the consequence of flow of electrical current and the electrical resistance of the coils. This heats the coils, and the direct contact of the water with the coils heat the water. The temperature of the water at the outlet is defined by a sum combination of the electrical energy and flow.

Figure 2:
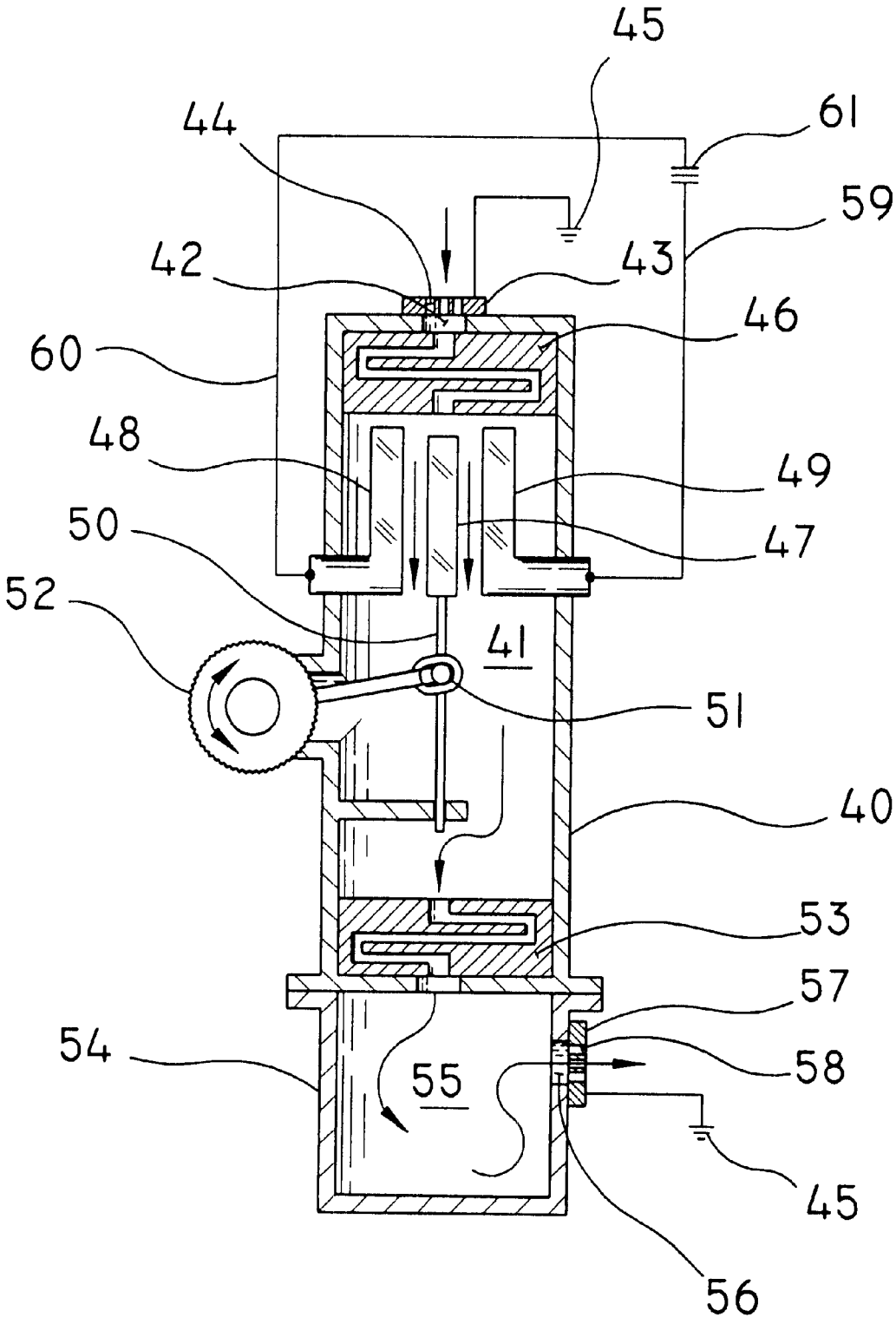
FIG. 2 is a schematic drawing showing a embodiment of a tankless water heater according to this invention, this one being a gravity drain water heater in which a manual temperature control is utilized.

An improved and simplified scheme of the invention is shown in FIG. 2. A main housing 40 is made of a non-electrically conductive material. It has a chamber 41 with a water inlet 42. A grounding screen 43 made of electrically conductive polymer has a plurality of holes 44 through it. It is attached to inlet 42 and is electrically connected to ground 45.

A non-conductive polymer field obstructor 46 is disposed between chamber 41 and inlet 42. An adjustable current gate 47 made of a non-conductive polymer is disposed between opposed electrodes 48, 49. The electrodes are made of, or at least surfaced by, an electrically conductive polymer.

A connecting rod 50 is attached to current gate 47. A pivot pin 51 is attached to connecting rod 50. Pivot pin 51 passes through a slot on the end of the arm that is attached to adjusting knob 52. A heated-water mixing reservoir housing 54 has a chamber 55 and an outlet 56. A field obstructor 53 is disposed between chamber 41 and chamber 55. A grounding screen 57 made of electrically conductive polymer having a plurality of holes through it is attached to outlet 56 and is electrically connected to ground 45.

Electrical leads 59, 60 are connected to respective electrodes 48, 49 and to a source of electrical current 61. In operation, the water heater's inlet is connected to an upstream valve for turning the water on and off, and its outlet is connected to a downstream spout or a shower-head. The water heater is mounted such that the inlet is up and the outlet is down so that gravity acting on the water will empty chamber 41 at the end of each use.

Water enters through grounding screen 44 and passes through inlet 42. It then passes through field obstructor 46 and between electrodes 48, 49, thereby filling chamber 41. The water passing between opposed electrodes 48 and 49 acts like a switch, completing the electrical circuit. The water is heated by way of its own electrical resistance. The heated water passes through field obstructor 53 into a hot water mixing reservoir chamber 55, and exits through a plurality of holes 58 in grounding screen 57.

The heated-water mixing reservoir 55 has a water capacity equal to or greater than chamber 41 and is used to collect heated water that has drained out of chamber 41 at the lower flow rates resulting from the elimination of pressure when the upstream valve is closed. This water, the remaining water in chamber 41 will have been heated to a higher temperature than desired for the desired usage. It can drain slowly after the pressure flow has stopped.

The temperature of the water in use is adjusted by turning adjusting knob 52. Turning this knob moves the current gate 47 so as to expose more or less of the faces of electrodes 48, 49 that are directly exposed to each other. Current drawn by the water is variably adjusted by the amount of exposed faces of the electrodes 48, 49, in the sense of confronting surfaces. The water is heated to a highest temperature with the greatest amount of face confrontation and to its lowest temperature with the least amount of face confrontation.

Knob 52 is used to adjust the output water to a desired temperature between the extremes.

Figure 3:
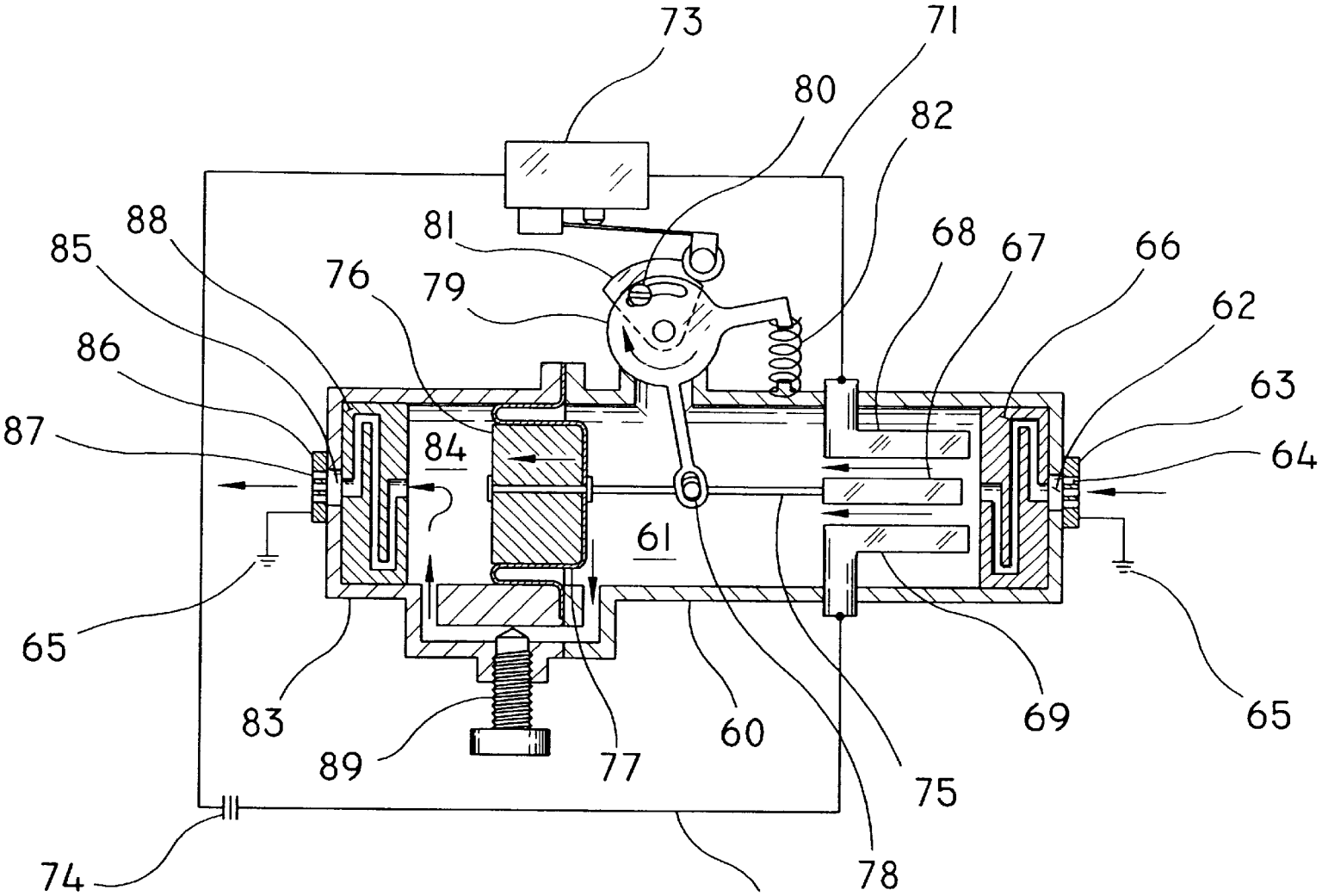
FIG. 3 is a schematic showing of a variation of the embodiment shown in FIG. 2, in which an automatic temperature control is utilized.

A further embodiment of the invention which implements the features of the prior embodiments, augmented by the addition of a rolling diaphragm, a throttling screw, a switch and a means for adjusting said current gate is shown in FIG. 3.

Referring to FIG. 3, a main housing 60 made of non-conductive material. It forms a chamber 61 with a water inlet 62. A grounding screen 63 made of an electrically conductive polymer with a plurality of holes 64 therethrough is attached to inlet 62 and is electrically connected to ground 65. A field obstructor 66 is disposed between chamber 61 and inlet 62. An adjustable current gate 67 made of a non-electrically conductive polymer is disposed between opposed electrodes 68, 69. The electrodes are made of an electrically conductive polymer. A switch 73 is attached to housing 60. Leads 71, 72 are connected to respective electrodes 68, 69 through switch 73 and to a source 74 of electrical current.

One lead of a connecting rod 75 is attached to current gate 67. The opposite end of this rod is attached to piston 76. It holds the rolling diaphragm 77 against the face of piston 76. A pivot pin 78 attached to the connecting rod 75 passes through a slot at the end of the arm of pivot plate 79. Pivot plate 79 is adjustably attached with a screw 80 to a switch cam plate 81. A spring 82 is disposed between the housing 60, biasing the pivot plate 79 in a counter-rotational direction to the arrow shown.

Screw 80 is loosened to adjust the switch activation set point relationship between pivot plate 79 and switch cam plate 81. This adjustment of the current gate 67 modifies the amount of opposed faces of the electrodes 68, 69 that are exposed to each other when switch 73 is actuated. When switch 73 is in the off position, as shown, the relationship of switch cam plate 81 and switch 73 maintain their relative positions while pivot plate 79 (which is attached to the connecting rod 75), current gate 67, diaphragm 77 and piston 76 are adjusted. This adjustment serves to match input voltage from power source 74 to the current draw of water flowing between the exposed faces of electrodes 68, 69.

A diaphragm housing 83 made of non-electrically conductive material has a chamber 84 with a water outlet 85. A grounding screen 86 made of an electrically conductive polymer having a plurality of holes 87 therethrough is attached to outlet 85 and is electrically connected to ground 65. A non-conductive polymer field obstructor 88 is disposed between chamber 84 and outlet 85. A water path connecting chamber 61 to chamber 84 is adjustably restricted by a throttling screw 89.

In operation, water to be heated enters through grounding screen 63, passes through field obstructor 66 and between electrodes 68, 69 thereby filling chamber 61. Heated water flows past the throttling screw 89 and into chamber 84, then through field obstructor 88 and grounding screen 86. From grounding screen 86 it flows to a point of use such as a faucet.

Moving water is restricted by the throttling screw 89. This imposes a drop in pressure in chamber 84 thus moving the rolling diaphragm 77 in the direction shown by the arrow. Attention is called to spring 82 which biases the pivot plate 79 and its attached pieces. The pressure drop imposed in chamber 84 is proportional to the variable water flow rate from the attached point of use, possibly a faucet. As the water flow increases at the faucet, the pressure progressively drops in chamber 84, and the diaphragm and its attached pieces move in the direction of the arrow. The pressure differential on the opposing side of diaphragm 77 is proportionally biased by spring 82. Spring 82 serves to regulate a compensatory exposure of the electrode faces 68, 69 by dynamically adjusting current gate 67 relative to the said pressure drop, thereby providing a means for issuing water at a constant temperature rise even for variable flow rates.

Electrical current is contained within chambers 61, 84 by way of an appropriate length of water path through the field obstructors 66, 88. Low leakage current escaping through obstructors 66, 88 is further eliminated by the inlet and outlet grounding screens 63, 86 that are connected to ground 65, making the unit safe. FIGS. 22–25 show field obstructor 66 (field obstructor 88 is similarly formed), with a later—described spiral path of significant length. This length provides electrical resistant in the stream of water sufficient to reduce leakage of current to a negligible valve. Grounding screens 63 and 86 can in fact be eliminated if a sufficient field obstructor are provided.

Figure 4:
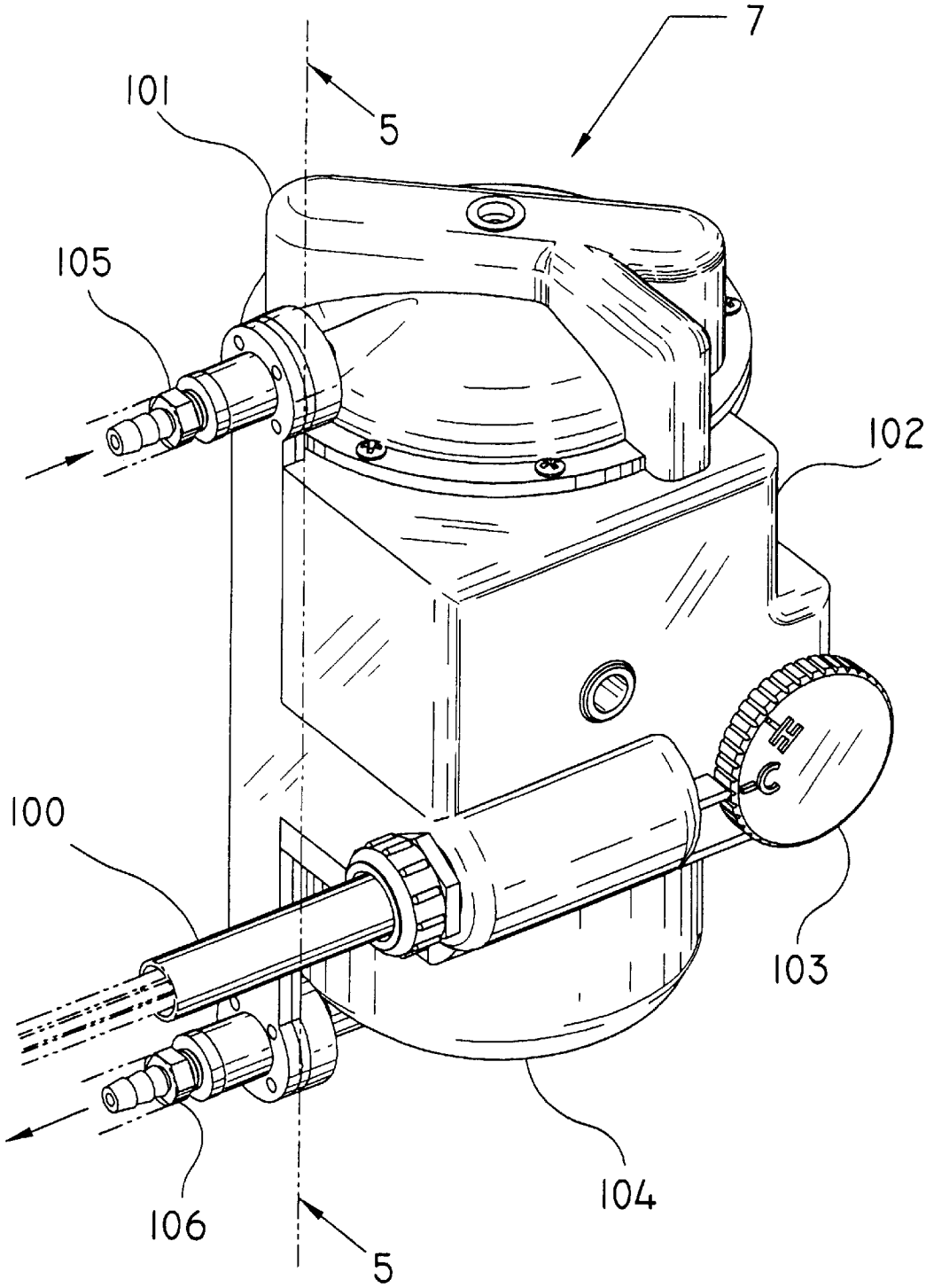
FIG. 4 is a perspective view of the embodiment of the basic schematic shown in FIG. 2.

FIG. 4 is a isometric view of a more refined embodiment of the structure shown in FIG. 2. It shows an electrical inlet 100, an end cap electrical cover 101, a main housing electrical cover 102, a temperature control knob 103, a heated water mixing reservoir 104, inlet 105, and an outlet 106. These items show the basic outside envelope of an embodiment properly called a "gravity drain water heater". In operation the unit will be in the upright attitude shown in FIG. 4 with inlet 105 above outlet 106. Its operation is the same as described for FIG. 2.

Figure 5:
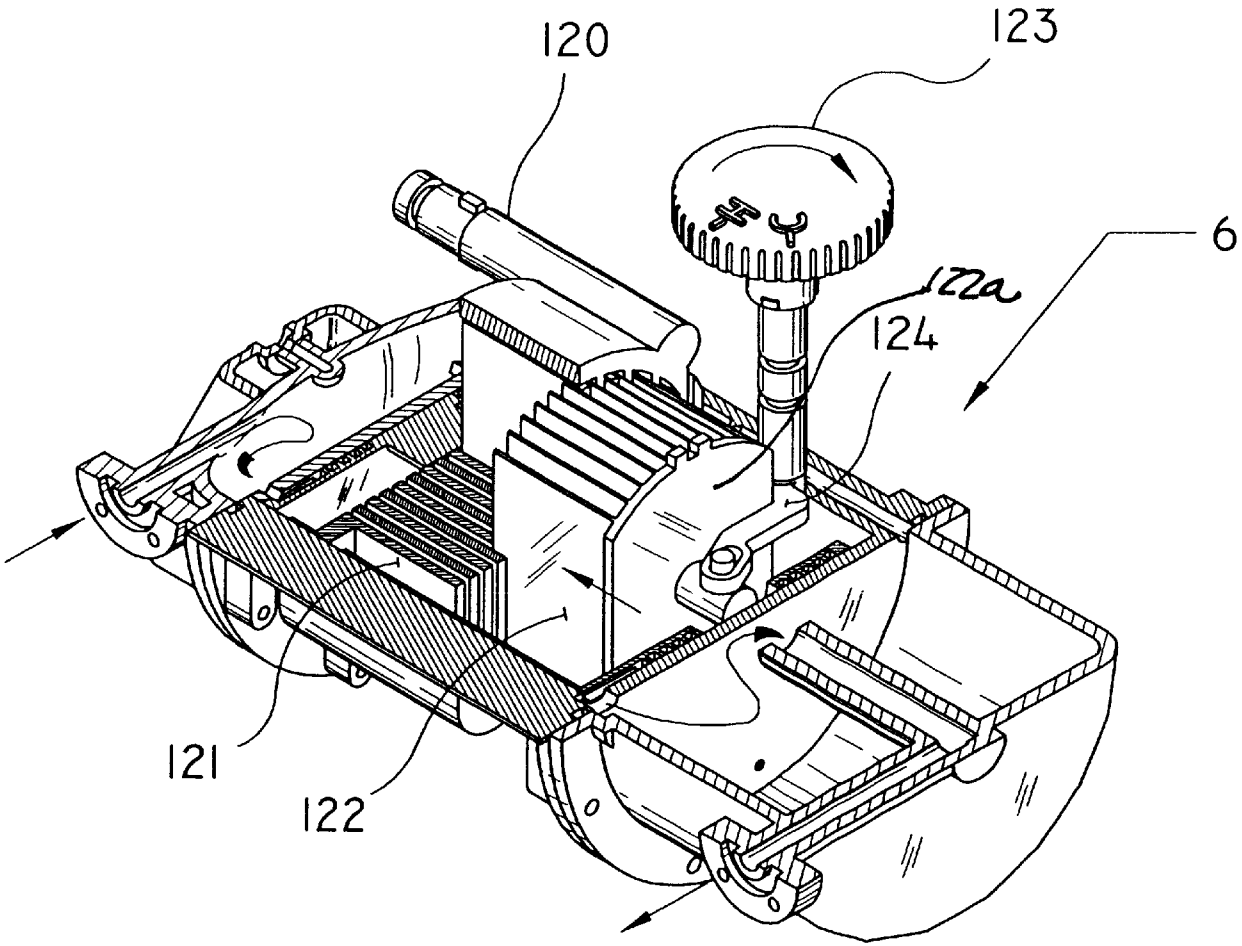
FIG. 5 is a cross-sectional view of the embodiment of FIG. 4.

FIG. 5 shows electrodes 120, 121 that are positioned to receive a current gate 122 between them. Current gate 122 is shown fully retracted, allowing maximum exposure of the opposed faces of electrodes 120, 121. In this position, the electrodes draw a maximum amount of current, the consequence of which is a flow of water that will be at its hottest. Turning knob 123 in the direction of the arrow shown will push the current gate in the direction of the arrow shown in between the blades of the electrodes 120, 121 by way of lever 124. This will produce heated water at a lower temperature.

It will be observed that the electrodes and also the current gate are provided as sets of parallel plates, so the leaves of the current gate are interleaved with the electrodes. Notice that the leaves of the current gate are integrally molded with an adjustable base 122*a* and the electrodes, suitably connected to leads, are fixed to the non-conductive housing.

Figure 6:
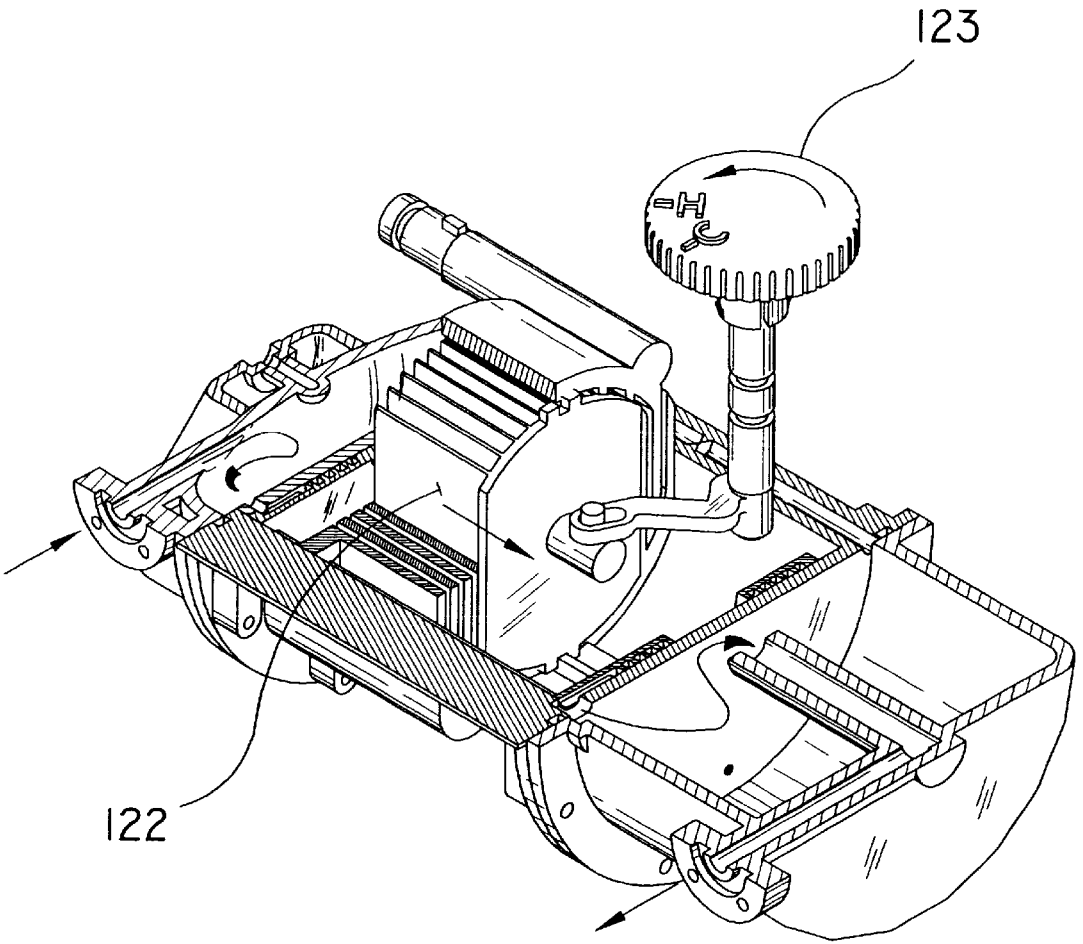
FIG. 6 is a cross-sectional view of the embodiment of FIG. 4 wherein the electrode is moved.

FIG. 6 shows a cross sectional view of the embodiment of FIG. 5 with current gate 122 fully inserted in between electrodes 120, 121 occluding direct exposure of the opposed faces of the electrodes. In this position, the electrodes draw a minimum amount of current. The consequence is a flow of water that will be at its coldest. Turning the knob 123 in the direction of the arrow shown will pull the current gate in the direction of the arrow shown to expose more of the faces of the electrodes to each other. This will produce water heated to a higher temperature.

Figure 7:
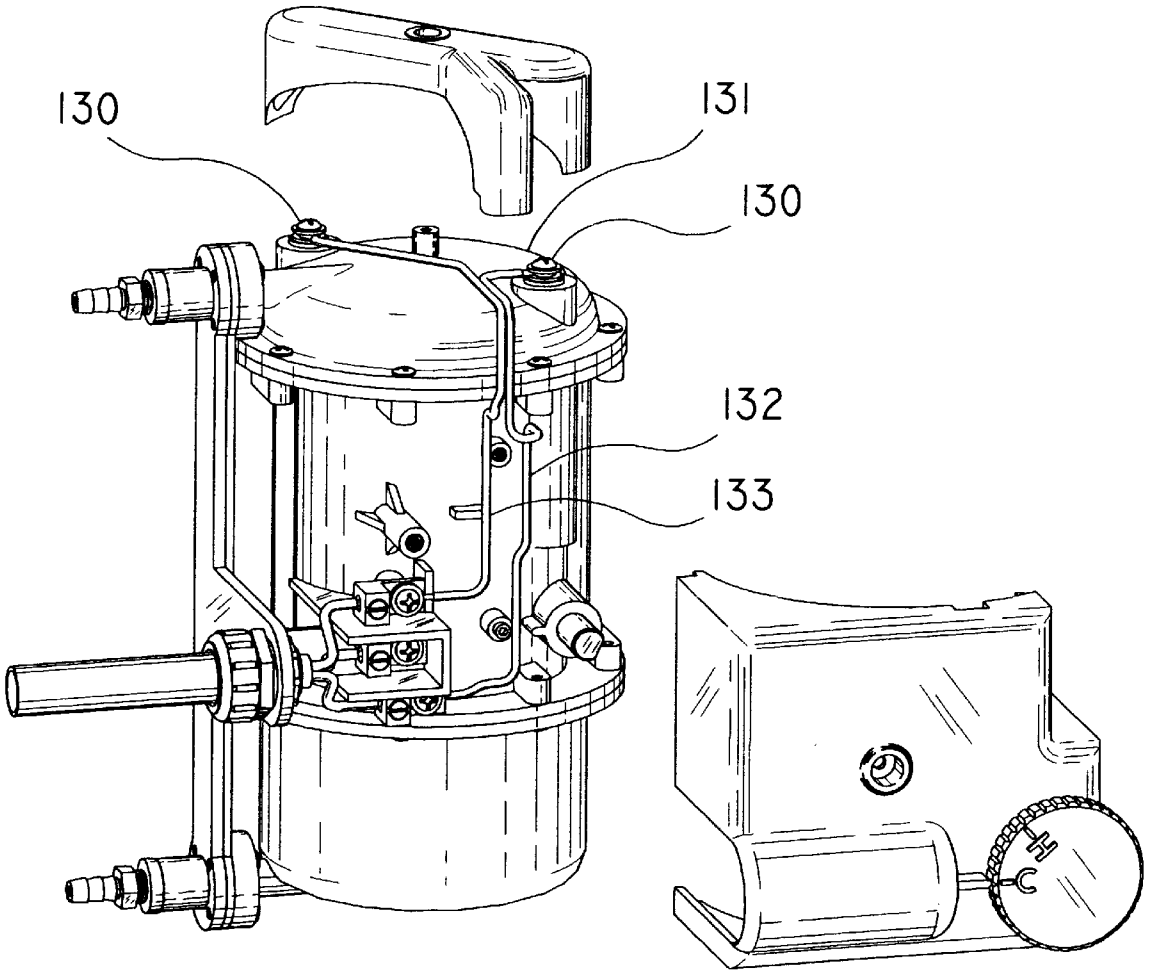
FIG. 7 is an exploded view of the embodiment shown in FIG. 4 in which the electrical covers are removed.

FIG. 7 shows the embodiment of FIG. 4 with its electrical wiring connections exposed. The connections 130 are attachment points for wires 132, 133 to make electrical connection to the internally mounted electrodes. Posts molded into the internal electrodes exit the injection molded end cap 131 in the manner shown for ease of molding and water sealing. The importance of which will be made apparent in the description of the construction of the electrodes. Notice the absence of metal on electrode surfaces that will be exposed to water.

Figure 8:
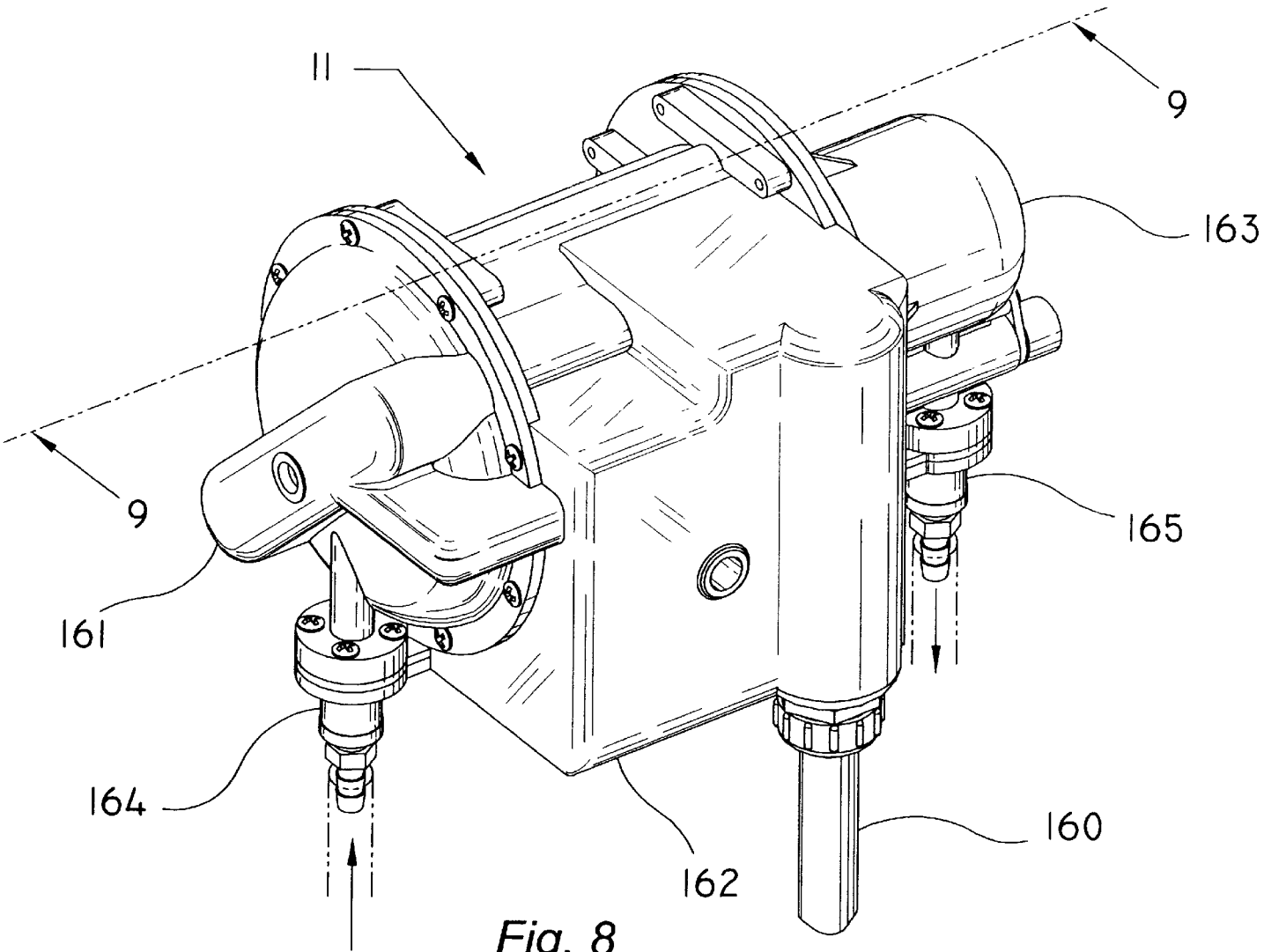
FIG. 8 is a perspective view of the embodiments of the basic structure shown in FIG. 3.

FIG. 8 is a more refined isometric view of the embodiment of FIG. 3 showing an electrical inlet 160, an end cap electrical cover 161, a main housing electrical cover 162, a rolling diaphragm housing 163, and inlet 164 and an outlet 165. These items show the basic outside envelope of the embodiment herein properly called the "auto-control water heater".

Figure 9:
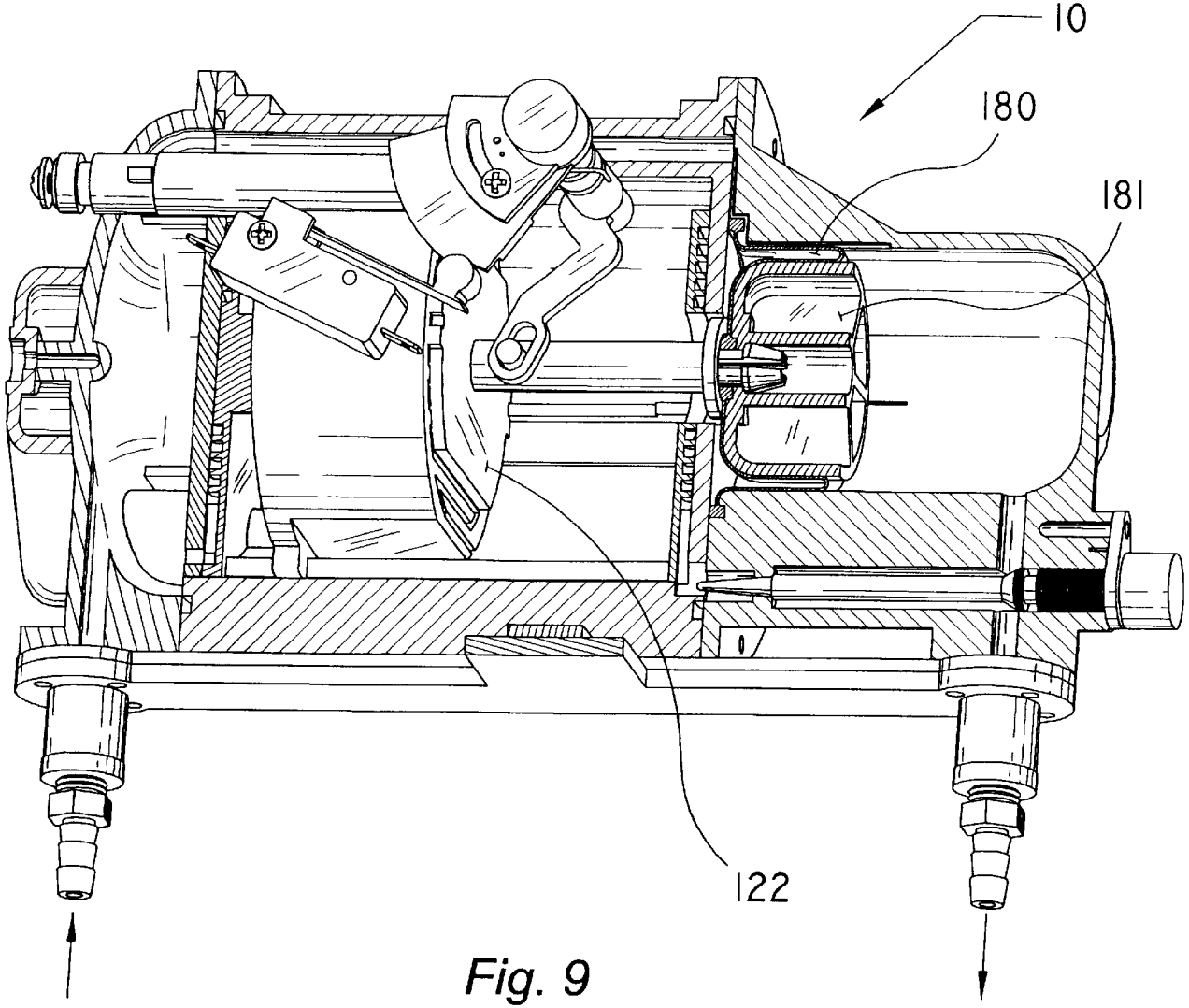
FIG. 9 is a cross-sectional view taken at line 9—9 in FIG. 8.

FIG. 9 shows a cross-sectional view of the embodiment of FIG. 8 utilizing a rolling diaphragm 180 and a piston 181 which act upon the current gate in the manner as described for the embodiment of FIG. 3.

Figure 10:
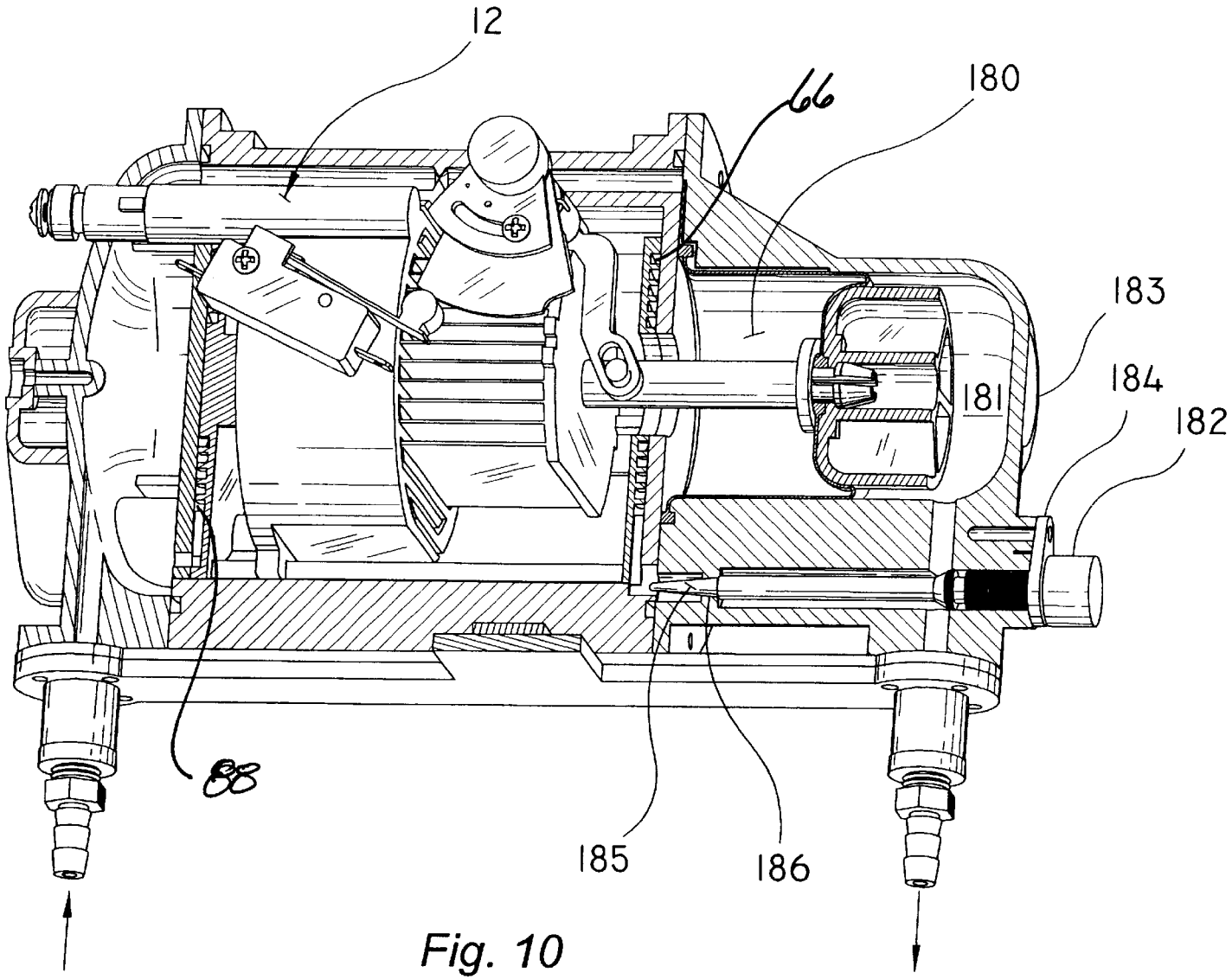
FIG. 10 is a cross-sectional view similar to FIG. 9 in another adjusted position.

FIG. 10 shows a cross-sectional view of the embodiment of FIG. 8 with the rolling diaphragm 180 unfolded to its extended position as a result of a drop in pressure in chamber 181 when the downstream faucet is opened. A throttling screw 182 is disposed in a water path in the diaphragm housing, and held in place with a threaded plate 184. The throttling screw 182 has a tapered end 185 matching a taper in a diaphragm housing 186. This allows for a high resolution adjustment of the throttling screw 182. The action of this screw is fully described above, for the embodiment of FIG. 3.

Figure 11:
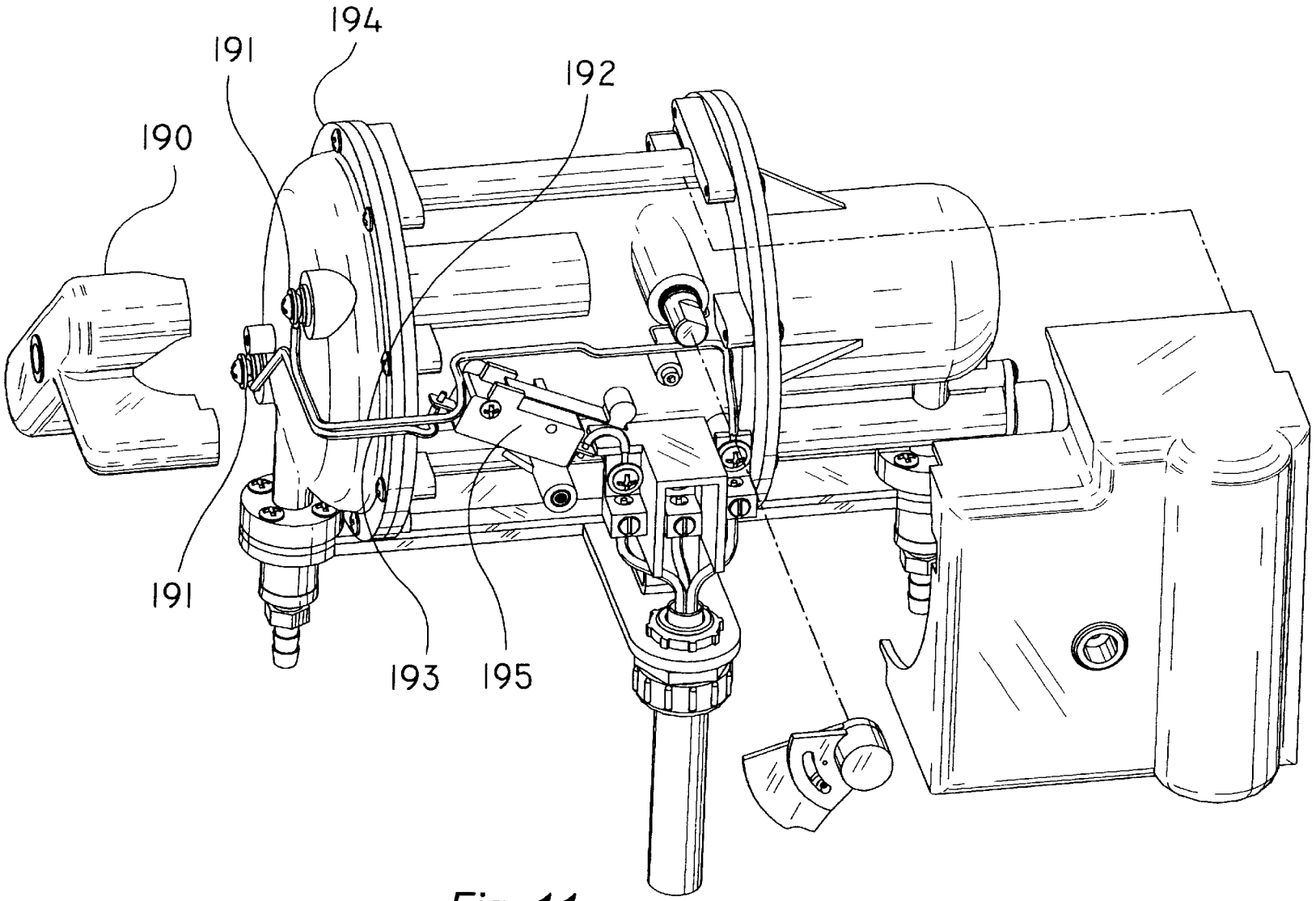
FIG. 11 is an exploded view of the structure shown in FIG. 8.

FIG. 11 shows the embodiment of FIG. 8 with exposed electrical wiring connections 191 as attachment points for wires 192, 193 to make electrical connection to the internally mounted electrodes. Posts molded into the internal electrodes exit the injection molded end cap 194 in the manner shown for ease of molding and water sealing. An electrical switch 195 is placed in the circuit, the action of which is fully described in the embodiment of FIG. 3.

Figures 12, 13:
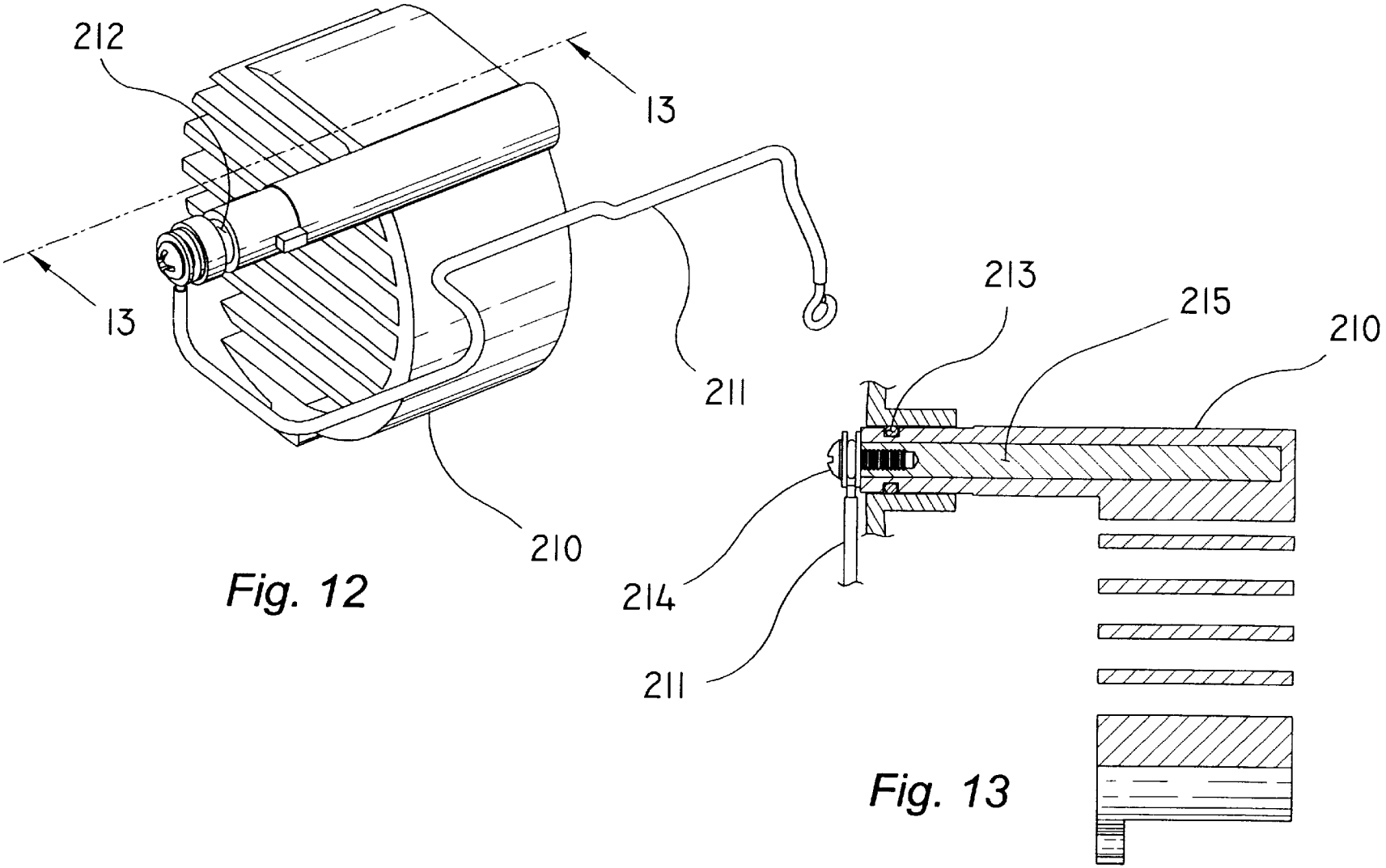
FIG. 12 is a perspective view of one electrode of the invention with a lead wire attached.
FIG. 13 is a cross-sectional view of the electrode shown in FIG. 12.

FIG. 12 shows a perspective view of one electrode 210 with one electrical wiring 211 connection attached. It includes a groove 212 for accepting a water sealing "O" ring 213 as shown in FIG. 13.

FIG. 13 is a cross section view of an electrically conductive resin electrode 210 and insert 215. This insert has threads to accept a terminal binding screw 214 as required by Underwriters Laboratories. The important requirement that all electrical attachments must be made to metal and not to plastic is satisfied by use of the said conductive elastomeric material's ability to accept molded metal inserts.

An "O" ring 213 used for sealing is placed in a groove 212 (FIG. 12). It is molded into the electrode. The resin may be thermosetting, but ordinarily will be a thermoforming plastic. An advantage of such resins for this invention is their corrosion resistance, very low electrical resistance, and resistance to physical damage by water hammering. Such resins also have the said advantage of being injection moldable so as to receive an insert by molding.

As will more fully be discussed below, the electrodes must not only be non-metallic, but have a very low resistivity. One would not ordinarily look to plastics for these features, especially when structural properties such as resistance to abrasion and physical shock such as water hammering are needed. In very recent years, an organic plastic material with these properties has been invented.

While the electrodes must have a substantial physical support and a metal connection for circuitry, it is possible now to provide an electrode suitably covered with a plastic material having the desired properties. At this point, Hayward U.S. Pat. No. 6,217,800, issued Apr. 17, 2001 is referred to, and incorporated in its entirety for its showing of such a plastic material. For full details of this material, reference should be made to this patent itself. Summarily it will be commented that a uniquely processed graphite is incorporated in a suitable resin, resulting in an actual, but suitably low resistivity.

Another Hayward U.S. Pat. No. 5,882,570 issued Mar. 16, 1999 which is also referred to and incorporated in its entirety for its showing of another conductive resin, is of lesser but definite interest. In this patent, the metallic element is incorporated in the graphite. This does expose water on the surface to a metal, but in the event the metal (in this case, nickel) is dissolved out, at least near the surface, an electrode of lesser advantage but still useful, could be made.

Attention is called to the very low amount of caloric heat in the electrode itself caused by current passing through the electrode. Because instant water heaters are mostly used intermittently, heat that goes into the electrode itself is often lost, rather than exchanged to water being heated for immediate use. Instead the residual heat from the electrodes will heat water that remains in the heater. With suitably low resistivity (which is not conventional in instant water heaters), the heat effect is in the water itself, instead of the in heating elements such as in resistive coils as in the prior art. The heating elements are not reservoirs of heat.

Suitable materials are not limited to the above examples: Any moldable polymer (loaded or unloaded with conductive materials) which has sufficiently low resistivity and sufficient durability will suffice.

The plastic material is resistant to the strong forces of water hammering that are so destructive of conventional wire coil heating elements. In addition, their moldability makes available shapes to regulate the water temperature that can not practically be made with metal.

The basic constructions shown in FIGS. 2 and 3 are suitable for many installations. However, while the advantages are that plates are easy to make and mount, the disadvantage is that the water flow is relatively smooth. Turbulent flow, and more compact constructions are potentially available when there is a broader selection of electrode shapes.

Figure 14:
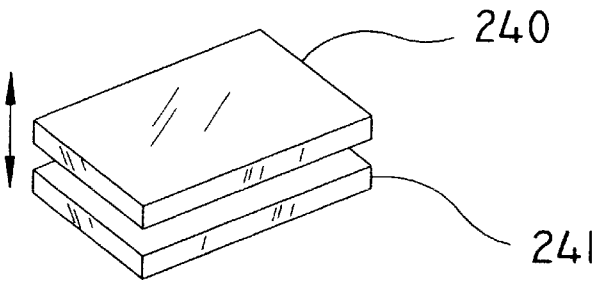

Temperature adjustment using parallel plate electrodes is shown in FIG. 14. In this example, electrodes 240 and 241 are moved in planar relationship as shown by the arrow to adjust the amount of confronting area and to move them toward and away from each other.

Figure 15:
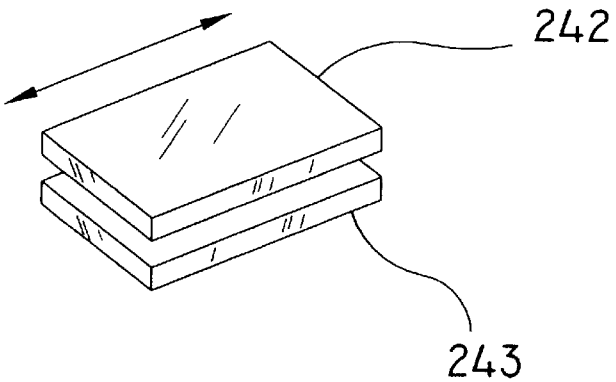

Temperature adjustment using parallel plate electrodes is also shown in FIG. 15. Electrodes 242 and 243 are moved in a linear relationship as shown by the arrow to adjust the amount of confronting area and to move them co-linear and parallel to each other.

Figure 16:
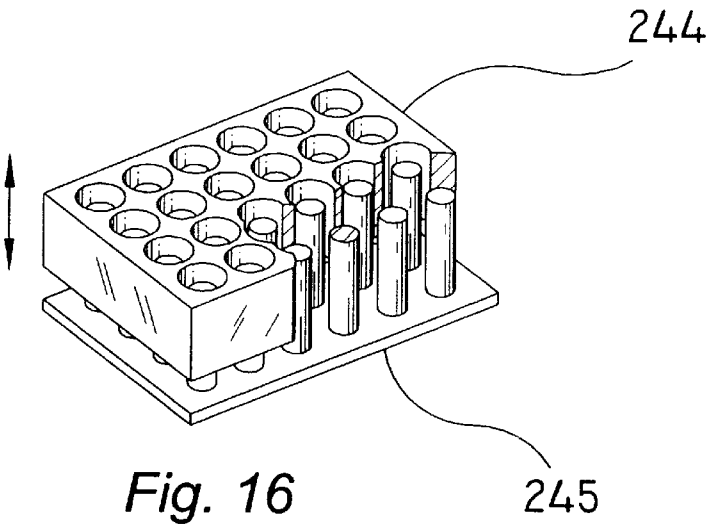
FIGS. 14, 15, 16, 17, 18, 19, 20 and 21 show other useful electrode configurations.

FIG. 16 shows temperature adjustment using one electrode having a plurality of holes 244 and a second electrode comprising a respective plurality of rods 245. In this arrangement the electrodes are moved in a linear relationship as shown by the arrow, thereby adjusting the amount of confronting area between them.

Figure 17:
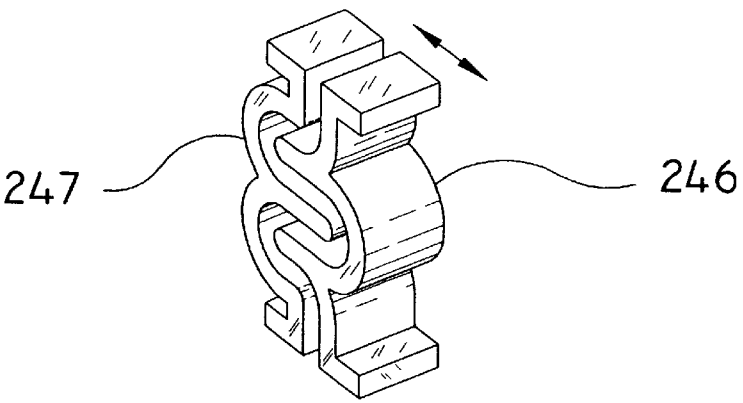

FIG. 17 shows a pair of electrodes 246, 247 forming a serpentine water path thereby compressing their confronting surface areas making for a more compacted configuration. These electrodes are moved in a linear relationship as indicated by the arrow.

Figure 18:
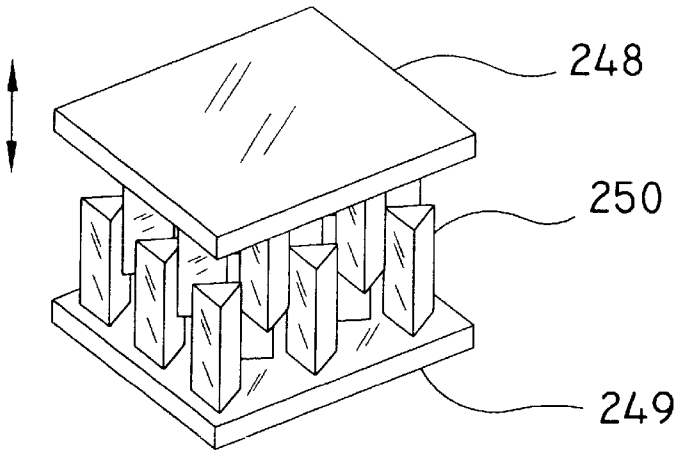

FIG. 18 shows a pair of electrodes 248, 249 using molded shaped posts 250 so that the flow of water through and in between the posts follows a more turbulent path.

Figure 19:
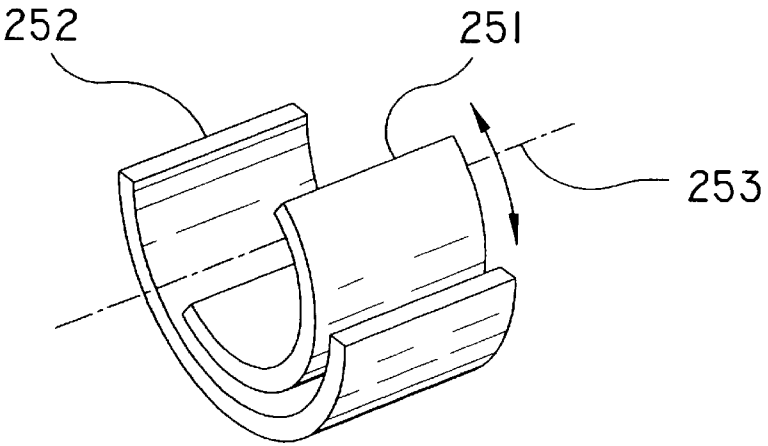

FIG. 19 shows a pair of fragments of cylindrical electrodes 251, 252 formed of linear fragments of cylinders rotatable around a common axis 253 relative to one another to adjust the amount of confronting areas. They could also be axially shiftable relative to one another for the same purpose.

Figure 20:
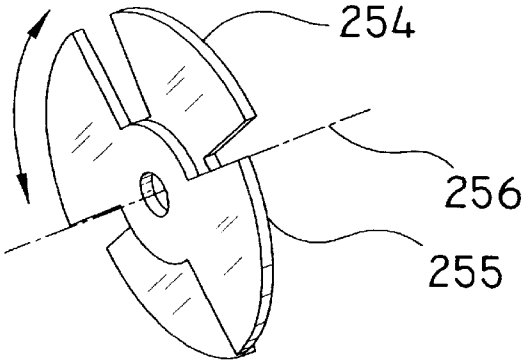

FIG. 20 shows a pair of butterfly wheel electrodes 254, 255 rotatably mounted on a common axis 256 to adjust the amount of confronting areas.

Figure 21:
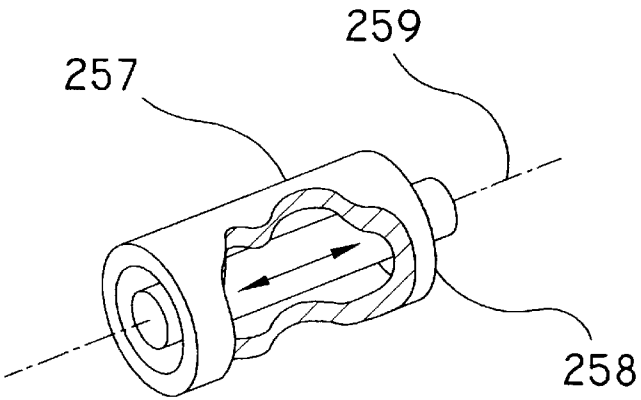

FIG. 21 shows two cylindrical electrodes 257, 258 relatively shiftable along their common axis 259 to adjust the amount of confronting areas.

In these arrangement, a separate current gate is not used. Current gates are moved between fixed electrodes. In these alternate arrangement, one or both electrodes are moved. In every situation the benefits of the plastic electrode are utilized.

This wide array of possible configurations with their individual advantages are available because of the unique nature of the electrodes. In addition to the configuration advantages, the novel electrode brings its own advantages such as impact resistance, low electrical resistivity, and insolubility.

It will be observed that, because the conductive polymer has such a low resistance, it scarcely heats at all. Instead, heating occurs almost exclusively in the water as the consequence of flow of current through it.

Figure 22:
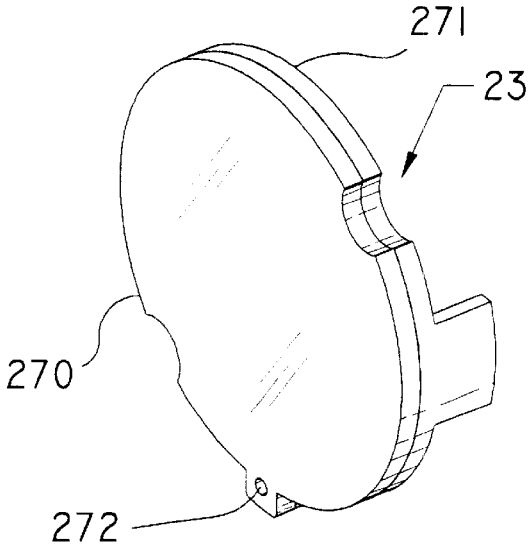
FIG. 22 is a perspective view showing one side of a field obstructor used in the embodiment of FIG. 10.

FIG. 22 shows a field obstructor 66 made up of two parts: a plate 270 having a flat surface on each side, and a confronting plate 271 disposed such that confronting faces of the plates press against each other. A water inlet hole 272 serves to allow incoming water between the two plates 270, 271.

Figure 23:
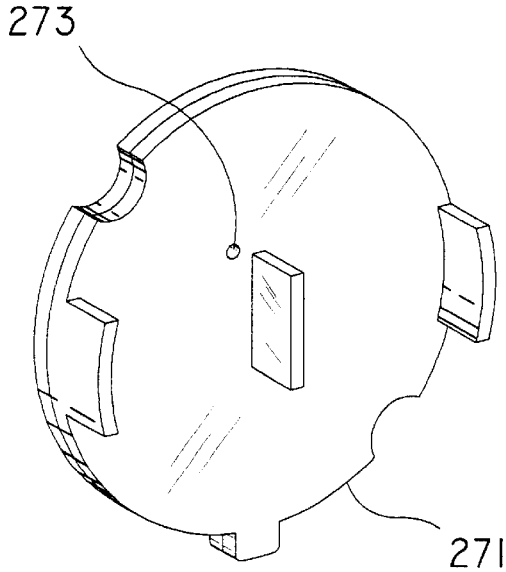
FIG. 23 is similar to FIG. 22, showing the other side of the same field obstructor.

FIG. 23 is a rotated view of plates 270, 271 showing a water exit hole 273.

Figure 24:
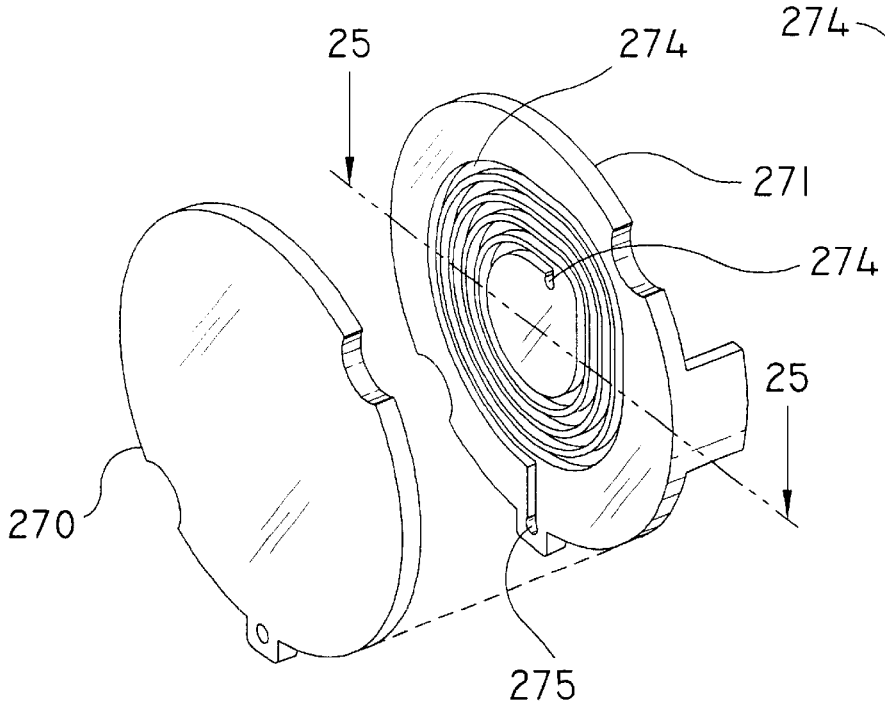
FIG. 24 is an exploded perspective view of the field obstructor of FIG. 22.

FIG. 24 shows plates 270 and 271 separated, exposing a spiral groove 274 that starts at the point 275 which aligns with inlet hole 272 of plate 270 and exits at point 274 and out hole 273 of FIG. 23. This groove has a length and cross-section, and forms the path for a field obstructor.

Figure 25:
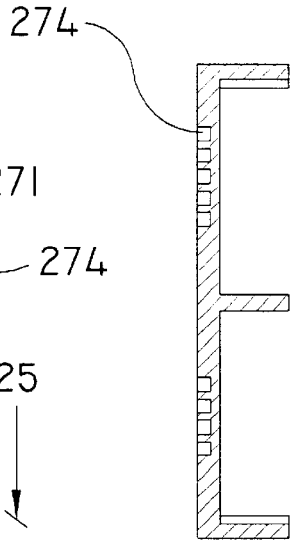
FIG. 25 is a cross section taken at line 25—25 in FIG. 24.

FIG. 25 is a cross-sectional view of plate 271 showing the spiral groove's depth and relative cross section. The spiral groove 274 need not be spiral in shape. A serpentine route, or maze-like design may instead be employed. The path length of the groove is based on a formula of electrical resistance of water, cross sectional area of the groove and path length. In every case, the lengthened path of high resistance water reduces any leakage current. Field obstructor 88 is similar in construction and intent to field obstructor 66.

Because the electrodes can be fixed in place in the preferred embodiments, there is no risk in such installations that there may be "hot spots". The plates in the current gate can in fact be off of parallel, because they are non-conductive. Their only function is to adjust the current flow by causing the flux lines to pursue paths of different length.

It is axiomatic that flux lines from one electrode to the other can not be cut. Ultimately they will all pass between the electrodes. However, in all embodiments of this invention, the lengths of these paths can be varied. The longer the path, the more resistance to flow and the lesser current flow along the particular path. As a consequence, the heating effect from the longer path is less than that in the shorter path. This is why, when the current gates are fully inserted between the plates there is greater resistance in the water paths. Lesser current then passes through the water and cooler water results.

When the electrodes are shifted relative to one another without a current gate, the length of the flux paths still changes, and creates the same effect.

The field obstructor at the ends of the heaters act to increase the resistance to current flow. This greatly reduces any leakage current that might ultimately reach a physical ground, often without needing a ground.

By providing a long water path at each end, for example as a coiled or serpentine flow path of relatively small cross-section, a long enough path in the water is provided that no risky current can escape. It has been found that a path length of about 30 inches with a ⅛th diameter cross section path will suitably isolate a heater using 110 volt current, and be useful safe on a sink faucet. Spiral-like channels for this purpose are shown in FIGS. 22–25.

This invention is not to be limited by the embodiments shown in the drawings and described in the description, which are given way of example and not of limitation, but only in accordance with the scope of the appended claims.

We claim:

1. An electrode for an instant water heater, said electrode being intended for submersion in a stream of water to be heated where it is likely to be subjected to water hammer forces and abrasive wear, and for conducting electricity for heating water between itself and a confronting similar electrode, said electrode being characterized by low electrical resistivity, by being injection molded, and by comprising a body of electrically conductive polymer without metal on surfaces intended to be exposed to water being heated.

2. An electrode according to claim 1 in which said polymer incorporates electrically conductive graphite mixed throughout.

3. An electrode according to claim 1 in which said electrode includes an inner metallic conductor, and an outer shell of said conductive and structural contact with said conductor, said conductor having a contactor for connection in a circuit.

4. An electrode according to claim 3 in which said contactor includes a stem mountable to water heater structure, to pass through an aperture in said structure and form a seal with said structure.

5. An instant water heater comprising:

a chamber having an inlet and outlet for water;

a pair of spaced-apart electrodes according to claim 1 in said chamber, said electrodes having confronting surfaces; said electrode being adapted to be connected to a source of electrical current;

whereby with water flowing between said electrodes is heated by electrical current flowing through said water from one electrode to the other electrode.

6. A water heater according to claim 5 in which at least one of said electrodes is movable relative to the other whereby adjustably to vary the areas of said surfaces which confront one another.

7. A water heater according to claim 6 in which said surfaces are parallel.

8. A water heater according to claim 7 in which said movable surface is movable linearly while the spacing between the plates is maintained constant.

9. A water heater according to claim 7 in which said movable surface is moved normally to said surfaces, changing the spacing between them, but maintaining them parallel to each other.

10. A water heater according to claim 6 in which said electrodes are fragments of coaxial cylinders, at least one of said electrodes being rotatable relative to the other to change the areas which confront one another.

11. A water heater according to claim 6 in which said surfaces are parallel vanes which are rotatable relative to one another whereby to vary the areas which confront one another.

12. A water heater according to claim 6 in which one of the electrodes is columnar column, and the other is tubular, said columns being axially movable in said tubular structure to vary the confronting areas of their surfaces.

13. A water heater according to claim 5 in which a current gate comprising a body of non-conductive material is placed between a pair of said electrodes with a spacing between said current gate and each of said electrodes, said electrodes and current gate being mounted such that the extent of direct exposure of the electrodes to each other is adjustable, whereby adjustably to vary the length of the flux path between them and thereby the resistance of the water path between them.

14. A water heater according to claim 13 in which said electrodes are provided as a group of substantially parallel plates, alternately connected in an electrical circuit, and said current gate is provided as a comb-like structure of parallel plates inserted between adjacent electrodes, said current gate being mounted for adjustable reciprocal movement relative to said electrodes.

15. A water heater according to claim 14 in which a lever connected to said current gate is accessible from the outside of the housing to shift the current gate relative to the electrodes.

16. A water heater according to claim 15 in which the position of the lever relative to the current gate is adjustable.

17. A water heater according to claim 13 in which a diaphragm exposed oppositely to pressure at the inlet and in the chamber actuates a switch to supply electrical current to the electrodes when chamber pressure decreases as the consequence of opening a user device downstream.

18. A water heater according to claim 13 in which said electrodes are provided as a group of substantially parallel plates, alternately connected in an electrical circuit, and said current gate is provided as a comb-like structure of parallel plates inserted between adjacent electrodes, said current gate being mounted for adjustable reciprocal movement relative to said electrodes; and in which a lever connected to said current gate is accessible from the outside of the housing to shift the current gate relative to the electrodes; and in which the position of the lever relative to the current gate is adjustable; and in which a field obstructor is placed in both the inlet and the outlet, said field obstructor comprising a water passage of significant length, whereby to provide a high resistance to electrical leakage current; and in which said water passage is a spiral in a flat plate; and in which a current ground comprising a ring-like structure of conductive plastic material is placed in the inlet or outlet, and grounded; and in which a second chamber is provided to received heated water from said first chamber, whereby to provide temporary storage for heated water after the current flow to the electrode has ceased; and in which a diaphragm exposed oppositely to pressure at the inlet and in the chamber actuates a switch to supply electrical current to the electrodes when chamber pressure decreases as the consequence of opening a user device downstream.

19. A water heater according to claim 5 in which a field obstructor is placed in both the inlet and the outlet, said field obstructor comprising a water passage of significant length, whereby to provide a high resistance to electrical leakage current.

20. A water heater according to claim 19 in which said water passage is serpentine.

21. A water heater according to claim 20 in which said water passage is a spiral in a flat plate.

22. A water heater according to claim 19 in which a current ground comprising a ring-like structure of conductive plastic material is placed in the inlet or outlet, and grounded.

23. Apparatus according to claim 5 in which a second chamber is provided to received heated water from said first chamber, whereby to provide temporary storage for heated water after the current flow to the electrode has ceased.

24. A water heater according to claim 5 in which a second chamber is provided to received heated water from said first chamber, whereby to provide temporary storage for heated water after the current flow to the electrode has ceased.

* * * * *